US011265979B1

(12) United States Patent
He

(10) Patent No.: US 11,265,979 B1
(45) Date of Patent: Mar. 1, 2022

(54) FLICKER LIGHT AND LIGHTING SHOE

(71) Applicant: Fully Electronics Co., Ltd, Fujian (CN)

(72) Inventor: Jinchun He, Fujian (CN)

(73) Assignee: FULLY ELECTRONICS CO., LTD

( * ) Notice: Subject to any disclaimer, the term of this patent is extended or adjusted under 35 U.S.C. 154(b) by 0 days.

(21) Appl. No.: 17/345,314

(22) Filed: Jun. 11, 2021

(30) Foreign Application Priority Data

Apr. 21, 2021 (CN) ..... 202110428761.7

(51) Int. Cl.
*H05B 45/10* (2020.01)
*F21V 15/01* (2006.01)
*F21V 23/00* (2015.01)
*F21Y 115/10* (2016.01)

(52) U.S. Cl.
CPC ..... *H05B 45/10* (2020.01); *F21V 15/01* (2013.01); *F21V 23/005* (2013.01); *F21Y 2115/10* (2016.08)

(58) Field of Classification Search
CPC ... F21V 15/01–012; F21V 23/003–009; F21Y 2115/10; H05B 45/10
USPC ..... 362/103
See application file for complete search history.

(56) References Cited

U.S. PATENT DOCUMENTS 5,746,499 A * 5/1998 Ratcliffe ..... A43B 1/0036 36/137
7,405,674 B2 7/2008 Tseng
2007/0159110 A1* 7/2007 Weng ..... A43B 3/001 315/185 S
2012/0262050 A1* 10/2012 Fan ..... F21S 4/10 313/317

* cited by examiner

*Primary Examiner* — Jason M Han
(74) *Attorney, Agent, or Firm* — McHale & Slavin, P.A.

(57) ABSTRACT

The present invention relates to the technical field of flicker lights, and particularly relates to a flicker light and a lighting shoe. The flicker light includes a lamp, and further includes a control module for generating irregular flicker signals. A signal output end of the control module is electrically connected with the lamp. Through the control module for generating the irregular flicker signals, the signal output end of the control module is electrically connected with the lamp, so that the work flicker time sequence of all LED lights on the lamp in the flicker light is irregular during work; moreover, the work time and number of the LED lights are different every time, thereby achieving a special flicker mode of the flicker light.

18 Claims, 8 Drawing Sheets

FLICKER LIGHT AND LIGHTING SHOE

CROSS REFERENCE TO RELATED APPLICATIONS

The present application claims the benefit of Chinese Patent Application No. 202110428761.7 filed on Apr. 21, 2021, the contents of which are incorporated herein by reference in their entirety.

TECHNICAL FIELD

The present invention relates to the technical field of flicker lights, and particularly relates to a flicker light and a lighting shoe.

BACKGROUND ART

At present, there are a lot of kinds of flicker lights on the market. The flicker time sequence modes of LED lights are diversified when in work. However, no matter what the flicker time sequence mode is, the LED lights work and output according to a certain time sequence mode, and the work lighting time is the same every time. For example, the flicker mode is clearly defined in the patent U.S. Ser. No. 11/317,364, but this work mode makes people feel dull and monotonous.

SUMMARY OF THE INVENTION

The technical problem to be solved by the present invention is to provide a flicker light and a lighting shoe, which enable the work flicker time sequence of all LED lights is irregular during the work, thereby improving the user experience.

To solve the above technical problems, the present invention adopts a first technical solution:

A flicker light includes a lamp, and further includes a control module for generating irregular flicker signals. A signal output end of the control module is electrically connected with the lamp.

To solve the above technical problems, the present invention adopts a second technical solution:

A lighting shoe includes a shoe body and the flicker light. The flicker light is arranged on the shoe body.

The present invention has the beneficial effects:

the flicker light designed in the present solution is provided with the control module for generating the irregular flicker signals, and the signal output end of the control module is electrically connected with the lamp, so that the work flicker time sequence of all LED lights on the lamp in the flicker light is irregular during work; moreover, the work time and number of the LED lights are different every time, thereby achieving a special flicker mode of the flicker light.

DESCRIPTION OF REFERENCE NUMERALS

1. Control box; 101. box body; 102. PCBA; 1021. anti-USB reverse connection protection module; 1022. charging management module; 1023. lithium battery charging/discharging protection module; 103. lithium battery; 104. vibration switch;

2. Flexible PCB; 201. control module; 202. lamp; 203. clear silicone rubber; 204. stitching locant line; 205. stitching line;

3. Charging switch;

4. Shoe body;

5. Display control box; 501. shell; 502. control IC; 503. display PCBA; 504. display vibration switch; 505. CR2032 battery;

6. LED light board; 601. LED display light; 602. display PCB.

DETAILED DESCRIPTION OF THE INVENTION

The technical content, objectives and effects of the present invention are described in detail below in conjunction with embodiments and accompanying drawings.

Figure 1:
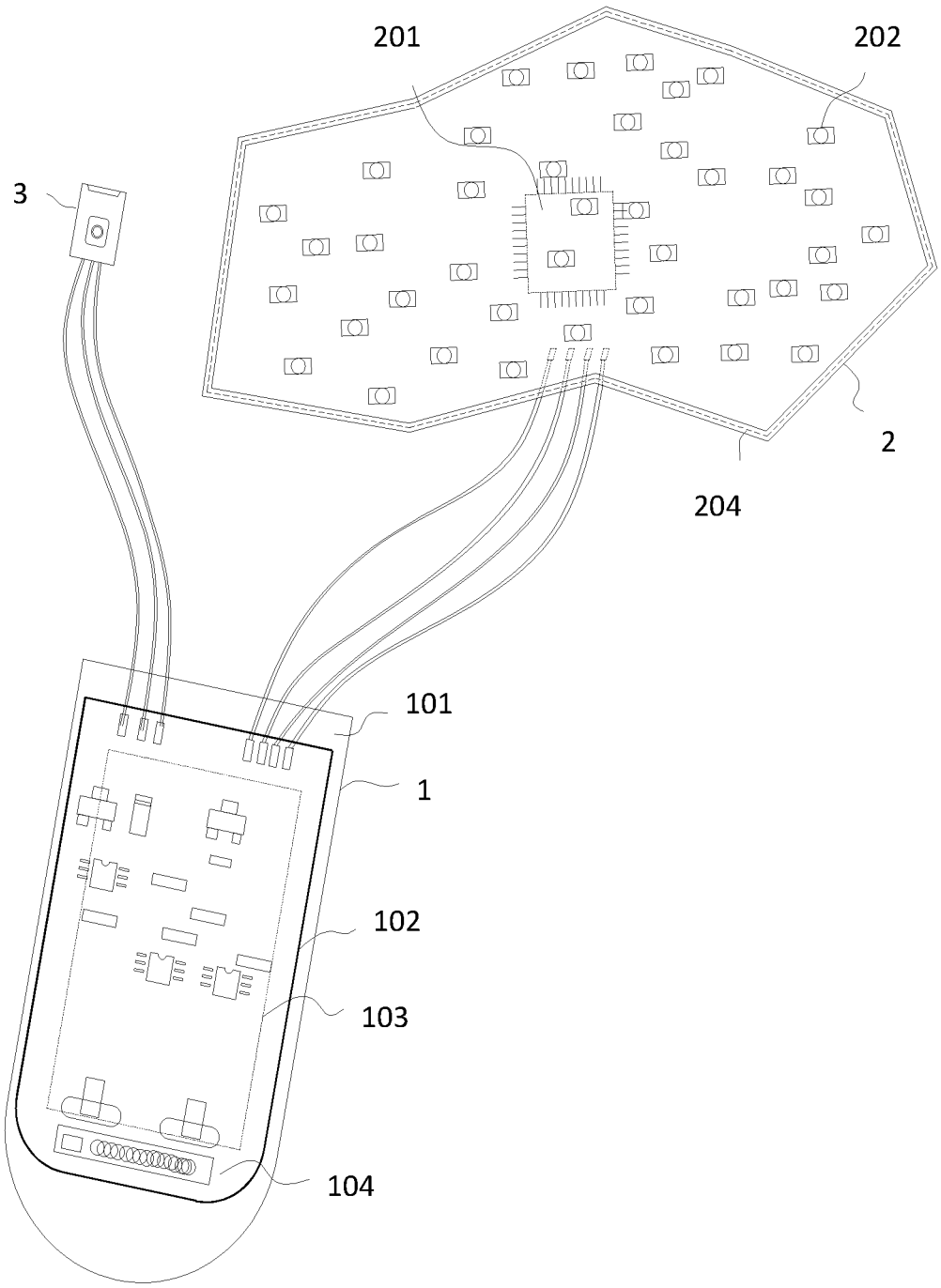
FIG. 1 is a structural schematic diagram of a flicker light according to the present invention.

Referring to FIG. 1, a technical solution provided by the present invention is as follows:

A flicker light includes a lamp, and further includes a control module for generating irregular flicker signals. A signal output end of the control module is electrically connected with the lamp.

It can be seen from the above description that the present invention has the beneficial effects:

The flicker light designed in the present solution is provided with the control module for generating the irregular flicker signals, and the signal output end of the control module is electrically connected with the lamp, so that the work flicker time sequence of all LED lights on the lamp in the flicker light is irregular during work; moreover, the work time and number of the LED lights are different every time, thereby achieving a special flicker mode of the flicker light.

Further, a random function code and a vibration frequency counter are prefabricated inside the control module.

It can be seen from the above description that one random function code and vibration frequency counter are prefabricated inside the control module, so that the flicker output mode is different every time when in work, and the work time may also change. When the vibration frequency of the apparatus increases, the work time may decrease, and otherwise, the work time may increase. Further, the lamp includes two or more luminous units. The two or more luminous units are electrically connected with the signal output end of the control module respectively. Each luminous unit is composed of LED lights. The LED lights adopt a scanning drive work mode.

It can be seen from the above description that the LED lights adopt the scanning drive work mode, so that more independent LED lights can be driven by using fewer drive ports.

Further, the control module and the lamp are integrally arranged on two opposite side surfaces of a flexible PCB respectively, and the surfaces of the control module and lamp are respectively covered with clear silicone rubber.

It can be seen from the above description that the control module and the lamp are integrally arranged on two opposite side surfaces of the flexible PCB respectively, and the surfaces of the control module and lamp are respectively covered with clear silicone rubber. By adopting the structural process, not only is the cost saved, and the production process completely mechanized, but also the resistance to the impact of external force is high.

Further, a bulb surface of the LED light is in a diamond prismatic shape.

It can be seen from the above description that the bulb surface of the LED light is in the diamond prismatic shape, so that the transmitted light may make people feel soft and peace after being reflected by the polygonal prismatic surface, and the brightness may not be attenuated.

Further, the flicker light further includes a control box and a charging switch. The control box includes a box body, and a PCBA, a lithium battery and a vibration switch which are arranged in the box body respectively. The PCBA is provided with an anti-USB reverse connection protection module, a charging management module and a lithium battery charging/discharging protection module. The control module is respectively electrically connected with the charging switch, the vibration switch and the charging management module. The charging switch is electrically connected with the anti-USB reverse connection protection module. The charging management module is respectively electrically connected with the anti-USB reverse connection protection module and the lithium battery charging/discharging protection module. The lithium battery is respectively electrically connected with the charging management module and the lithium battery charging/discharging protection module.

It can be seen from the above description that by arranging the anti-USB reverse connection protection module, when the user reverses the polarity of charging positive and negative electrodes, the damage of the back-end circuit can be avoided during the charging, thereby preventing the charging accident. By arranging the lithium battery charging/discharging protection module which is used to protect the overcharge and overdischarge of the battery, the overdischarge damage or safety accident caused by the overcharge or overdischarge of the battery can be prevented during the charging; and the control module is configured to drive and display different flicker time sequences and different flicker time of the LED lights every time when in work.

Further, the anti-USB reverse connection protection module includes a field effect tube Q1. A grid electrode of the field effect tube Q1 is grounded. A drain electrode of the field effect tube Q1 is electrically connected with the charging switch. A source electrode of the field effect tube Q1 is electrically connected with the charging management module.

It can be seen from the above description that by arranging the field effect tube Q1, if the user reverses the polarity of the charging positive electrode and negative electrode when in charging, the voltage on the grid electrode of the field effect tube Q1 is changed to a high level, and the field effect tube Q1 is disconnected then, so that the charging accident can be prevented.

Further, the lithium battery charging/discharging protection module includes a resistor R2, a resistor R3, a capacitor C3, a battery BT, a first lithium battery protection chip U2 and a second lithium battery protection chip U3. An output pin of an overdischarge detection circuit of the first lithium battery protection chip U2 is electrically connected with a first grid electrode pin of the second lithium battery protection chip U3. A negative electrode input pin of a charger of the first lithium battery protection chip U2 is electrically connected with one end of the resistor R3. The other end of the resistor R3 is electrically connected with a second source electrode pin of the second lithium battery protection chip U3, and the other end of the resistor R3 and the second source electrode pin of the second lithium battery protection chip U3 both are grounded. An output pin of an overcharge detection circuit of the first lithium battery protection chip U2 is electrically connected with the second grid electrode pin of the second lithium battery protection chip U3. A power supply positive electrode pin of the first lithium battery protection chip U2 is respectively electrically connected with one end of the resistor R2 and one end of the capacitor C3. A ground pin of the first lithium battery protection chip U2 is respectively connected with the other end of the capacitor C3, the first source electrode pin of the second lithium battery protection chip U3 and a cathode of the battery BT. The other end of the resistor R2 is electrically connected with an anode of the battery BT. The other end of the resistor R2 and the anode of the battery BT both are electrically connected with the lithium battery. The first source electrode pin of the second lithium battery protection chip U3 is electrically connected with the second drain electrode pin of the second lithium battery protection chip U3.

It can be seen from the above description that the resistor R3 is a current detection resistor, which plays a protective role when the output is overcurrent or the output is short-circuited. The resistor R2 is a current limiting resistor, which plays a role in stabilizing the power supply of the power supply positive electrode pin of the first lithium battery protection chip U2 and reinforcing ESD. The capacitor C3 is a filter capacitor, which can stabilize the power supply of the power supply positive electrode pin of the first lithium battery protection chip U2. The second lithium battery protection chip U3 is a dual-MOS tube combined element, which is equivalent to a bidirectional controllable electronic switch, and can control the input and output of the battery to work under a normal condition.

Further, the charging management module includes a resistor R1, a capacitor C1 and a lithium battery charging chip U5. An open-drain charging state output pin of the lithium battery charging chip U5 is electrically connected with the control module. A ground pin of the lithium battery charging chip U5 is grounded. A charging current output pin of the lithium battery charging chip U5 is electrically connected with the lithium battery. A power supply positive electrode pin of the lithium battery charging chip U5 is respectively electrically connected with one end of the capacitor C1 and the anti-USB reverse connection protection module. The other end of the capacitor C1 is grounded. A charging current control pin of the lithium battery charging chip U5 is grounded through the resistor R1.

It can be seen from the above description that a charging management IC of the lithium battery charging chip U5 plays a main role in providing a stable and rational voltage and current when the battery is charged. The capacitor C1 connected with the power supply positive electrode pin of the lithium battery charging chip U5 is a filter capacitor, which plays a role in stabilizing the input voltage. The charging current control pin of the lithium battery charging chip U5 is connected with the external resistor R1, so that the resistor R1 is a current control resistor.

Figure 8:
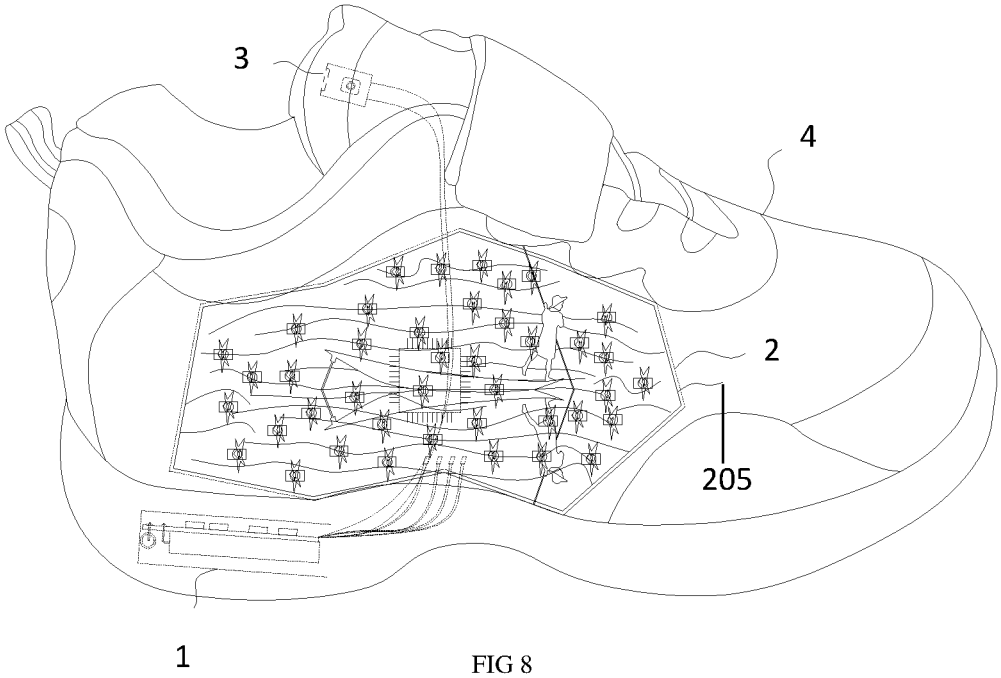
FIG. 8 is a structural schematic diagram of a lighting shoe according to the present invention.

Referring to FIG. 8, a technical solution provided by the present invention is as follows:

A lighting shoe includes a shoe body and the flicker light. The flicker light is arranged on the shoe body.

It can be seen from the above description that the present invention has the beneficial effects:

The flicker light designed in the present solution is provided with the control module for generating the irregular flicker signals, and the signal output end of the control module is electrically connected with the lamp, so that the work flicker time sequence of all LED lights on the lamp in the flicker light is irregular during work; moreover, the work time and number of the LED lights are different every time, thereby achieving a special flicker mode of the flicker light. The flicker light of the above structure is applied to a lighting shoe, which can improve the experience of users.

Figure 2:
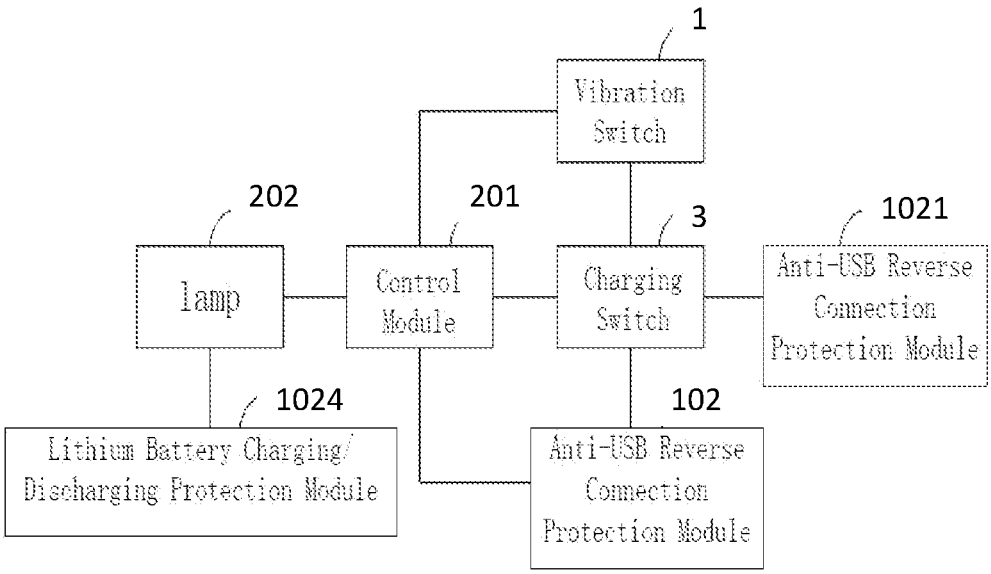
FIG. 2 is a block diagram illustrating connection of modules of the flicker light according to the present invention.

Referring to FIG. 1 to FIG. 7, and FIG. 9 to FIG. 11, an embodiment I of the present invention is as follows:

Referring to FIG. 1 and FIG. 2, a flicker light includes a lamp 202, and further includes a control module 201 for generating irregular flicker signals. A signal output end of the control module 201 is connected with the lamp 202.

A random function code and a vibration frequency counter are prefabricated inside the control module 201.

Figure 6:
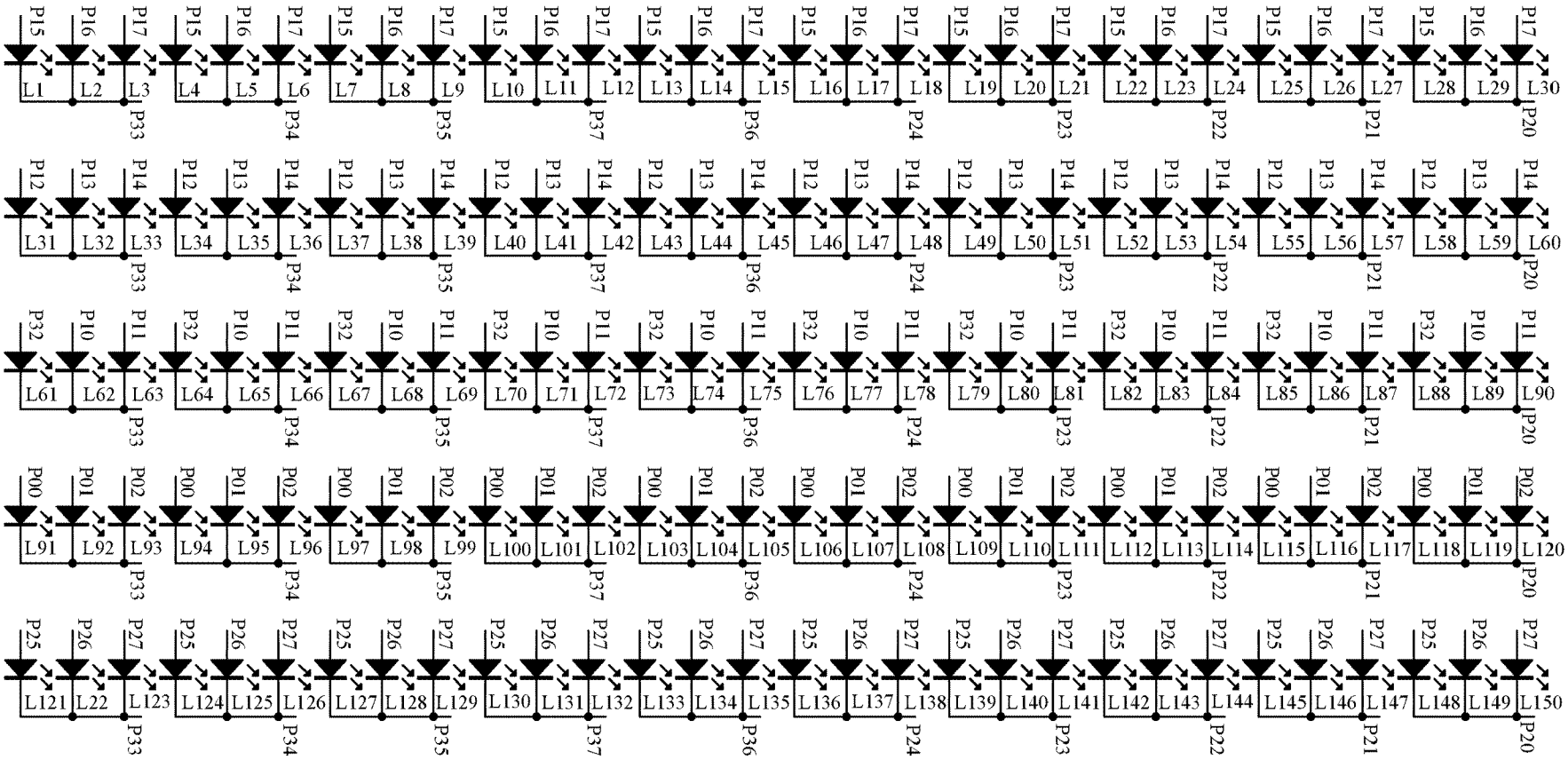
FIG. 6 is a schematic circuit diagram of a lamp of the flicker light according to the present invention.

Referring to FIG. 6, the lamp 202 includes two or more luminous units. The two or more luminous units are respectively electrically connected with the signal output end of the control module 201. Each luminous unit is composed of LED lights. The LED lights adopts a scanning drive work mode. The LED lights of each luminous unit are encapsulated by SMT0805 and covered with clear silicone rubber 203 on the surface, so that not only can the LED light body be protected against damage, but also the weakening of light transmission can be avoided. At the same time, when the LED light is applied to the lighting shoe, since the clear silicone rubber 203 can filter partial blue light in LED, eyes can be protected.

Figure 7:
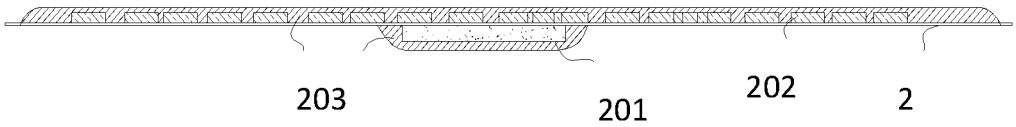
FIG. 7 is a sectional view of a flexible PCB of the flicker light according to the present invention.

Referring to FIG. 1, FIG. 7, and FIG. 8, an embodiment II of the present invention is as follows:

The embodiment II differs from the embodiment I in that: referring to FIG. 1 and FIG. 7, the flicker light further includes a flexible PCB 2. The control module 201 and the lamp 202 are integrally arranged on two opposite side surfaces of the flexible PCB 2 respectively, and the surfaces of the control module 201 and lamp 202 are respectively covered with clear silicone rubber 203.

Referring to FIG. 1 and FIG. 8, an edge of the other side surface opposite to one side surface of the flexible PCB 2 is provided with a stitching locant line 204 which is used for installing a stitching line 205.

A bulb surface of the LED light is in a diamond prismatic shape.

The control module 201 and the LED light 202 of the flicker light designed in the present solution are integrally arranged on two opposite side surfaces of the flexible PCB 2 respectively, and the clear silicone rubber 203 is dripwise poured for protection. By adopting the above structure process, not only is the cost saved, and the production process completely mechanized, but also the resistance to the impact of the external force is large. The lamp 202 adopts a scanning drive mode, so that more independent LED lights can be driven by using fewer drive ports. The flicker mode is unique and non-repetitive, and the work time can change with the walking speed.

Referring to FIG. 1 to FIG. 5, an embodiment III of the present invention is as follows:

The embodiment III differs from the embodiment I in that: referring to FIG. 1 and FIG. 2, the flicker light further includes a control box 1 and a charging switch 3. The control box 1 includes a box body 101, and a PCBA 102, a lithium battery 103 and a vibration switch 104 which are respectively arranged in the box body 101. The PCBA 102 is provided with an anti-USB reverse connection protection module 1021, a charging management module 1022 and a lithium battery charging/discharging protection module 1023. The control module 201 is respectively electrically connected with the charging switch 3, the vibration switch 104 and the charging management module 1022. The charging switch 3 is electrically connected with the anti-USB reverse connection protection module 1021. The charging management module 1022 is respectively electrically connected with the anti-USB reverse connection protection module 1021 and the lithium battery charging/discharging protection module 1023. The lithium battery 103 is respectively electrically connected with the charging management module 1022 and the lithium battery charging/discharging protection module 1023.

Figure 3:
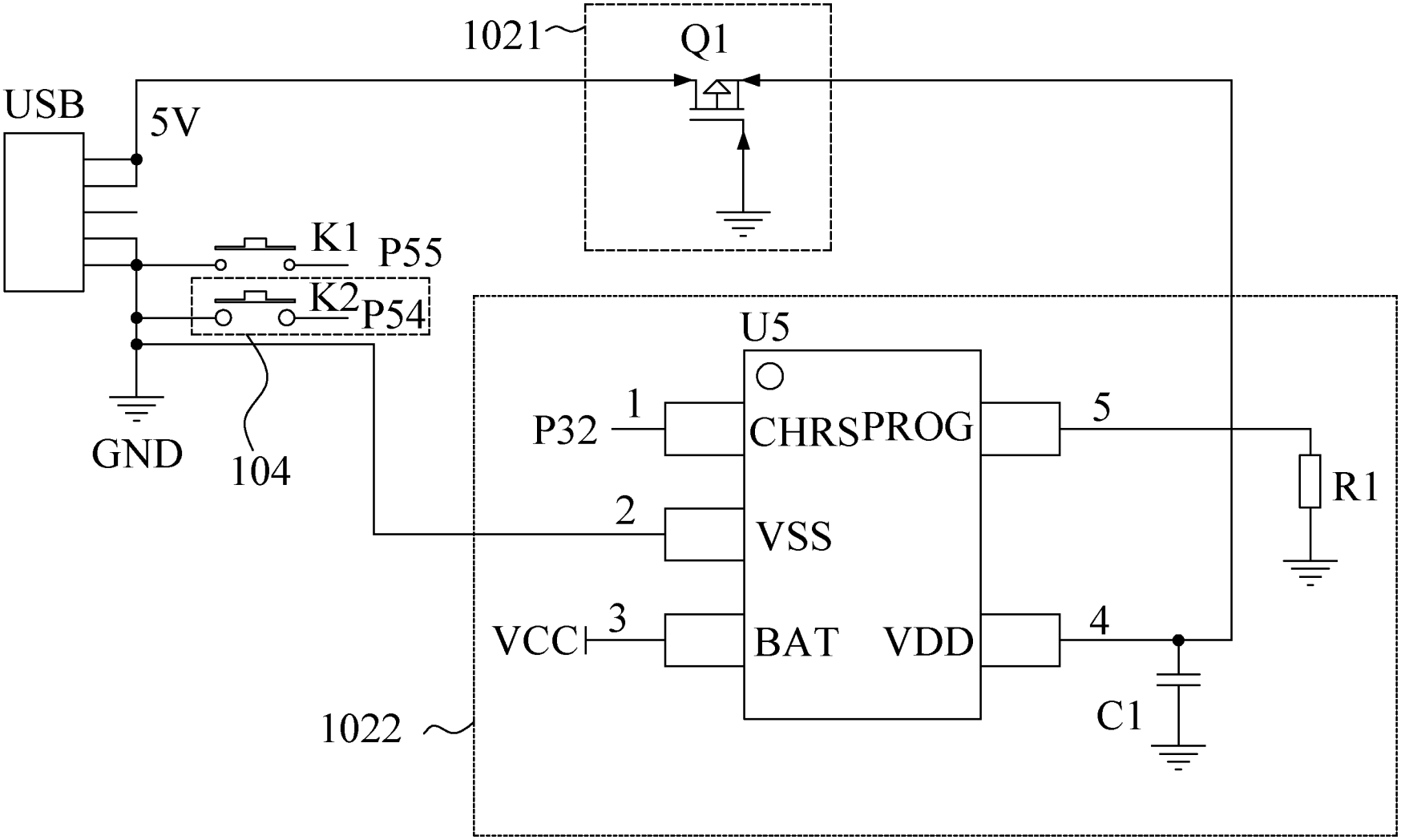
FIG. 3 is a schematic circuit diagram of a charging switch, a vibration switch, an anti-USB reverse connection protection module and a charging management module according to the present invention.

Referring to FIG. 3, the anti-USB reverse connection protection module 1021 includes a field effect tube Q1. A grid electrode of the field effect tube Q1 is grounded. A drain electrode of the field effect tube Q1 is electrically connected with the charging switch 3. A source electrode of the field effect tube Q1 is electrically connected with the charging management module 1022.

Figure 4:
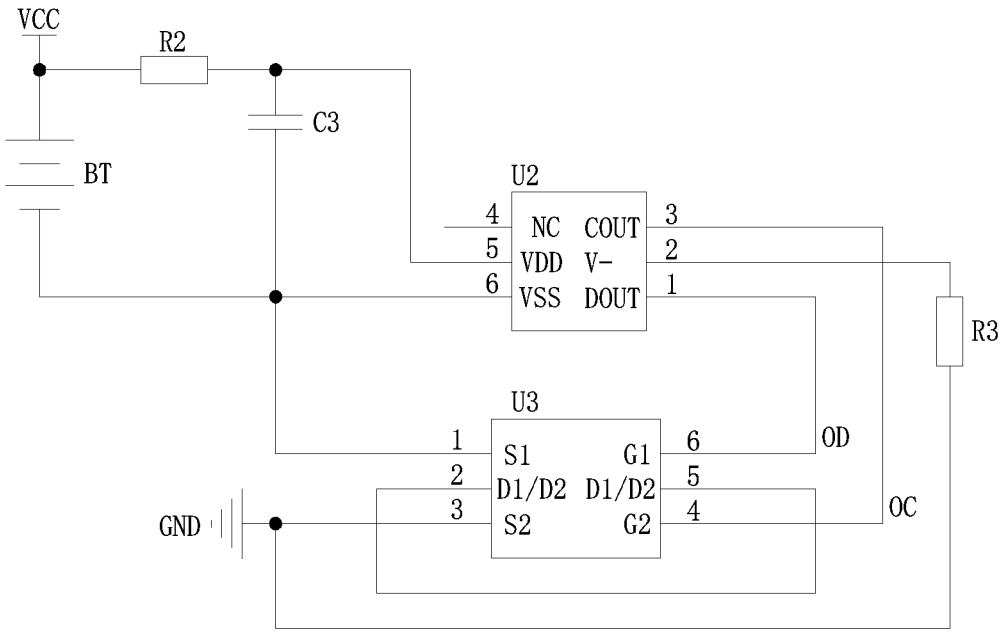
FIG. 4 is a schematic circuit diagram of a lithium battery charging/discharging protection module of the flicker light according to the present invention.

Referring to FIG. 4, the lithium battery charging/discharging protection module 1023 includes a resistor R2 (the resistance is 100Ω), a resistor R3 (the resistance is 1 kΩ), a capacitor C3 (the capacitance is 0.1 μF), a battery BT, a first lithium battery protection chip U2 (the model is DW01) and a second lithium battery protection chip U3 (the model is 8205A). An output pin of an overdischarge detection circuit of the first lithium battery protection chip U2 is electrically connected with a first grid electrode pin of the second lithium battery protection chip U3. A negative input pin of a charger of the first lithium battery protection chip U2 is electrically connected with one end of the resistor R3. The other end of the resistor R3 is electrically connected with a second source electrode pin of the second lithium battery protection chip U3, and the other end of the resistor R3 and the second source electrode pin of the second lithium battery protection chip U3 both are grounded. An output pin of an overcharge detection circuit of the first lithium battery protection chip U2 is electrically connected with a second grid electrode pin of the second lithium battery protection chip U3. A power supply positive electrode pin of the first lithium battery protection chip U2 is respectively electrically connected with one end of the resistor R2 and one end of the capacitor C3. A ground pin of the first lithium battery protection chip U2 is respectively electrically connected with the other end of the capacitor C3, a first source electrode pin of the second lithium battery protection chip U3 and a cathode of the battery BT. The other end of the resistor R2 is electrically connected with an anode of the battery BT. The other end of the resistor R2 and the anode of the battery BT both are electrically connected with the lithium battery. A first drain electrode pin of the second lithium battery protection chip U3 is electrically connected with a second drain electrode pin of the second lithium battery protection chip U3.

The resistor R3 is a current detection resistor, which plays a protective role when the output is overcurrent or the output is short-circuited.

The resistor R2 is a current limiting resistor, which can stabilize a power supply of the power supply positive electrode pin of the first lithium battery protection chip U2 and reinforce ESD.

The capacitor C3 is a filter capacitor, which can stabilize the power supply of the power supply positive electrode pin of the first lithium battery protection chip U2.

The second lithium battery protection chip U3 is a dual-MOS tube combined element, which is equivalent to a bidirectional controllable electronic switch, and can control the input and output of the battery to work under a normal condition.

The working principle of the lithium battery charging/discharging protection module 1023 is described as follows:

1) Under normal conditions (the voltage of the battery is 3-4.2 V), a first pin (i.e. the output pin of the overdischarge detection circuit) and a third pin (i.e. the output pin of the overcharge detection circuit) of the first lithium battery protection chip U2 output a high level, then a first pin (i.e. the first source electrode pin) and a third pin (i.e. the second source electrode pin) of the second lithium battery protection chip U3 are switched on, and then the cathode and a ground end of the battery are switched on, so that the whole circuit forms a path.

2) In an overcharge protection state, when in charging and when the voltage of the battery reaches 4.25 V, the first lithium battery protection chip U2 detects a signal through a fifth pin (i.e. the power supply positive electrode pin), the third pin (i.e. the output pin of the overcharge detection circuit) of the first lithium battery protection chip U2 outputs a low voltage, and then the first pin (i.e. the first source electrode pin) and the third pin (i.e. the second source electrode pin) of the second lithium battery protection chip U3 are disconnected, so that the whole circuit forms an open circuit.

3) In an overdischarge protection state, when the voltage of the battery is less than 3 V, the first lithium battery protection chip U2 detects the signal through the fifth pin (i.e. the power supply positive electrode pin), the third pin (i.e. the output pin of the overcharge detection circuit) of the first lithium battery protection chip U2 outputs a low voltage, and then the first pin (i.e. the first source electrode pin) and the third pin (i.e. the second source electrode pin) of the second lithium battery protection chip U3 are disconnected, so that the whole circuit forms an open circuit.

4) In a discharge overcurrent protection state, when the output current of the battery is greater than a preset value, the first lithium battery protection chip U2 detects the signal through the resistor R3, and the signal is inputted into the first lithium battery protection chip U2, then the first pin (i.e. the output pin of the overdischarge detection circuit) of the first lithium battery protection chip U2 outputs a low voltage, and then the first pin (i.e. the first source electrode pin) and the third pin (i.e. the second source electrode pin) of the second lithium battery protection chip U3 are disconnected, so that the whole circuit forms an open circuit.

5) In an output short-circuit protection state, when the output current of the battery is suddenly infinite, then the first lithium battery protection chip U2 detects the signal through the resistor R3, and the signal is inputted into the first lithium battery protection chip U2, the first pin (i.e. the output pin of the overdischarge detection circuit) of the first lithium battery protection chip U2 instantaneously outputs a low voltage, and then the first pin (i.e. the first source electrode pin) and the third pin (i.e. the second source electrode pin) of the second lithium battery protection chip U3 are disconnected, so that the battery and corresponding elements and devices are protected against damage, and accidents can be prevented.

Referring to FIG. 3, the charging management module 1022 includes a resistor R1 (the resistance is 3.9 kΩ), a capacitor C1 (the capacitance is 0.1 μF) and a lithium battery charging chip U5. An open-drain charging state output pin of the lithium battery charging chip U5 is electrically connected with the control module 201. A ground pin of the lithium battery charging chip U5 is grounded. A charging current output pin of the lithium battery charging chip U5 is electrically connected with the lithium battery 103. The power supply positive electrode pin of the lithium battery charging chip U5 is respectively electrically connected with one end of the capacitor C1 and the anti-USB reverse connection protection module 1021. The other end of the capacitor C1 is grounded. The charging current control pin of the lithium battery charging chip U5 is grounded through the resistor R1.

A charging management IC of the lithium battery charging chip U5 plays a main role in providing a stable and rational voltage and current when the battery is charged.

The open-drain charging state output pin of the lithium battery charging chip U5 outputs a low level during normal charging and outputs a high level when the battery is fully charged, (the low level mentioned in the present solution refers to the voltage at the ground end and the voltage is 0V; and the high level is equal to or slightly less than VCC voltage).

The capacitor C1 connected with the power supply positive electrode pin of the lithium battery charging unit U5 is a filter capacitor, which plays a role in stabilizing the input voltage.

The charging current control pin of the lithium battery charging chip U5 is connected with the resistor R1, so that the resistor R1 is a current control resistor.

The working principle of the charging management module 1022 is described as follows:

1) When the battery capacity is low, the lithium battery charging chip U5 then adopts a constant-current charging mode, and the lithium battery charging chip U5 charges the battery at a maximal design current. Then the first pin (i.e. the open-drain charging state output pin) of the lithium battery charging chip U5 is in a low level state, and the chip U4 in the control module 201 outputs a charging prompt display way after receiving the signal.

2) When the battery is almost fully charged (the voltage of the battery then almost reaches the intrinsic voltage of the battery), then a constant-voltage charging mode is adopted, that is, the lithium battery charging chip U5 charges the battery at a small current in a stable maximal output voltage mode. Then the first pin (i.e. the open-drain charging state output pin) of the lithium battery charging chip U5 is still in a low level state, and similarly the charging prompt display way is displayed.

3) When the battery is fully charged (the voltage already reaches the intrinsic voltage of the battery), no current flows through the third pin (i.e. a power supply output pin) of the lithium battery charging chip U5, and the first pin (i.e. the open-drain charging state output pin) of the lithium battery charging chip U5 is changed to a high level state. Then the chip U4 in the control module 201 receives the signal and closes the charging display output way and enters a sleep state.

Figure 5:
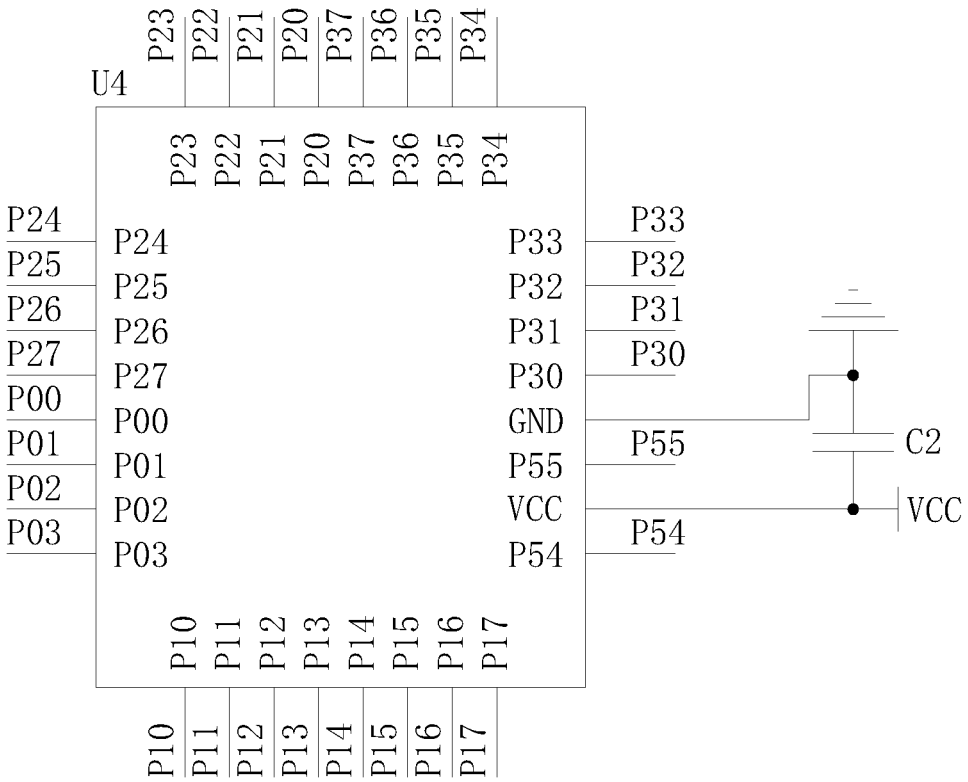
FIG. 5 is a schematic circuit diagram of a control module of the flicker light according to the present invention.

Referring to FIG. 5, the control module 201 includes a capacitor C2 (the capacitance is 0.1 μF) and a chip U4 (the model is STC8F2K64S2). A $32^{nd}$ pin (i.e. a charging indication signal input pin) of the chip U4 is electrically connected with the charging management module 1022. A $54^{th}$ pin (i.e. a vibration trigger signal input pin) of the chip U4 is electrically connected with the vibration switch 104. A $55^{th}$ pin (i.e. an on/off control pin) of the chip U4 is electrically connected with the charging switch 3. A VCC pin of the chip U4 is electrically connected with a ground pin of the chip U4 through the capacitor C2.

A random function code and a vibration frequency counter are prefabricated inside the chip U4. A rand function is prefabricated in a program. When in work, the vibration switch vibrates and generates a trigger signal (i.e. a signal inputted by the $54^{th}$ pin of the chip U4), and then the chip U4 may call the function and generate a group of numbers, which controls a work state of the LED lights through the corresponding output ports. Because the number generated by calling the function every time drives the LED lights to work for a short time, and there is only one mode (the time is about 100 ms), generally in the program, the chip U4 calls the function continuously for multiple times after receiving one trigger signal (for example, the flicker time in a work period is 3 s, the mode is changed every 100 ms, so the function needs to be read for 30 times, and 30 different flicker modes are generated in one period).

Referring to FIG. 3, the charging switch 3 includes a charging interface USB and a tact switch K1. One end of the tact switch K1 is grounded. The other end of the tact switch K1 is electrically connected with the control module 201. A first pin of the charging interface USB is respectively electrically connected with a second pin of the charging interface USB and the anti-USB reverse connection protection module 1021.

When in work, after the apparatus finishes the charging (for safety in charging, the apparatus cannot work during the charging, the tact switch and the vibration switch 104 are invalid, that is, the tact switch and the vibration apparatus cannot start the apparatus to work either), the tact switch is touched, so that the apparatus enters a work standby state, and a spring in the vibration switch 104 of the vibration apparatus (for simulating normal walk of the human body) vibrates and generates a pulse signal to awaken and start the control IC 502 (then the IC is set in a sleep state for power conservation), and the control IC 502 begins to work normally and drives the LED lights to emit light.

The anti-USB reverse connection protection module 1021 is composed of a P-type MOS tube, which plays a role in preventing the damage of the back-end circuit and preventing the charging accident when the user reverses the polarity of the positive and negative electrodes during the charging.

The control module 201 is composed of a LQFP-encapsulated single chip microprocessor (the chip U4). A random function flicker code is prefabricated in the single chip microprocessor to drive and display different flicker time sequences and different time of the LED lights every time.

The charging management module 1022 is composed of an independent charging management IC (i.e. the lithium battery charging chip U5) and peripheral auxiliary elements and devices. The model of the IC is TP4054.

The lithium battery charging/discharging protection module 1023 is composed of a management protection IC (i.e. the first lithium battery 103 protection chip U2 with the model of DW01) and a dual-MOS (i.e. the first lithium battery 103 protection chip U3 with the model of 8205) and peripheral auxiliary elements and devices. The main function is to protect the overcharge and overdischarge of the battery, thereby preventing the overdischarge damage of the battery when in overcharge or overdischarge or preventing the safety accident during the charging.

When in charging, an external power supply is inputted through the charging interface USB and reaches the charging management module 1022 through the anti-USB reverse connection protection module 1021. The charging management module converts the inputted voltage 5V to a constant-current constant-voltage mode (the battery is first charged at the constant current, and when the charging voltage reaches the intrinsic voltage of the battery, the battery is charged at a constant-voltage charging mode), and the voltage passes through the lithium battery charging/discharging protection module 1023 to finally enter the lithium battery 103. During the charging, the first pin (i.e. the open-drain charging state output pin) of the lithium battery charging chip U5 outputs a low level signal and sends the low level signal into the single chip microprocessor (i.e. the chip U4) of the control module 201, so that the single chip microprocessor works and indicates a charging state. When the battery is fully charged, the first pin (i.e. the open-drain charging state output pin) of the lithium battery charging chip U5 is changed to a high level, and the single chip microprocessor works, indicates the full battery capacity and stops the indication.

When in work, after the apparatus finishes the charging (for safety in charging, the apparatus cannot work during the charging, the tact switch and the vibration switch 104 are invalid, that is, the tact switch and the vibration apparatus cannot start the apparatus to work either), the tact switch is touched, so that the apparatus enters a work standby state, and a spring in the vibration switch 104 of the vibration apparatus (for simulating normal walk of the human body) vibrates and generates a pulse signal to awaken and start the chip U4 in the control module 201 (the chip U4 then is set in a sleep state for power conservation), and the chip U4 begins to work normally and drives the LED lights to emit light (in order to save resources and drive more LED lights to work in different ways, the drive mode of the LED light is a scanning mode. For example, the conventional flicker light drive mode at present is that one IC output end can only independently control the work state of one LED light; however, by adopting the scanning mode, the LED lights controlled by the same number of output ports can be doubled. For example, the control module 201 can independently control the display mode of 150 light emitting diodes only with 25 ports).

One random function code and vibration frequency counter are prefabricated inside the chip U4, so that the flicker output way is different every time when in work, and the work time may also change. When the vibration frequency of the apparatus increases, the work time may decrease, and otherwise, the work time may increase.

Figure 9:
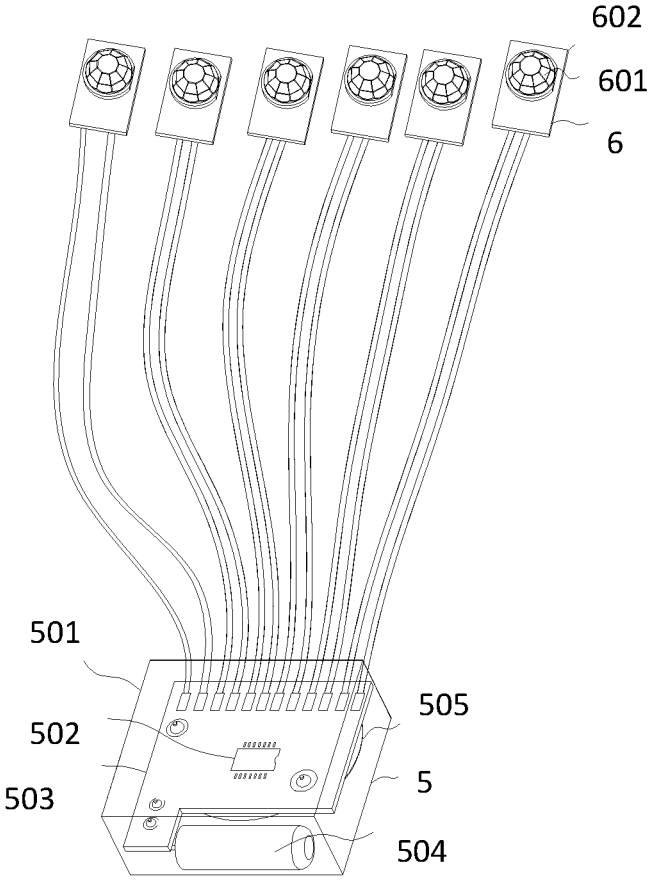
FIG. 9 is another structural schematic diagram of the flicker light according to the present invention.
Figure 10:
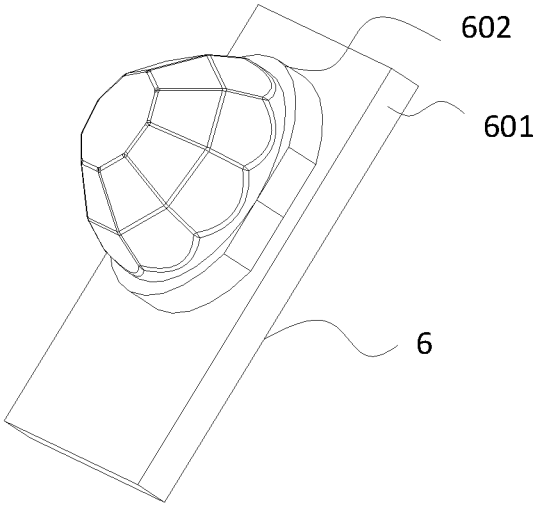
FIG. 10 is a structural schematic diagram of an LED light board in FIG. 9 of the flicker light according to the present invention.
Figure 11:
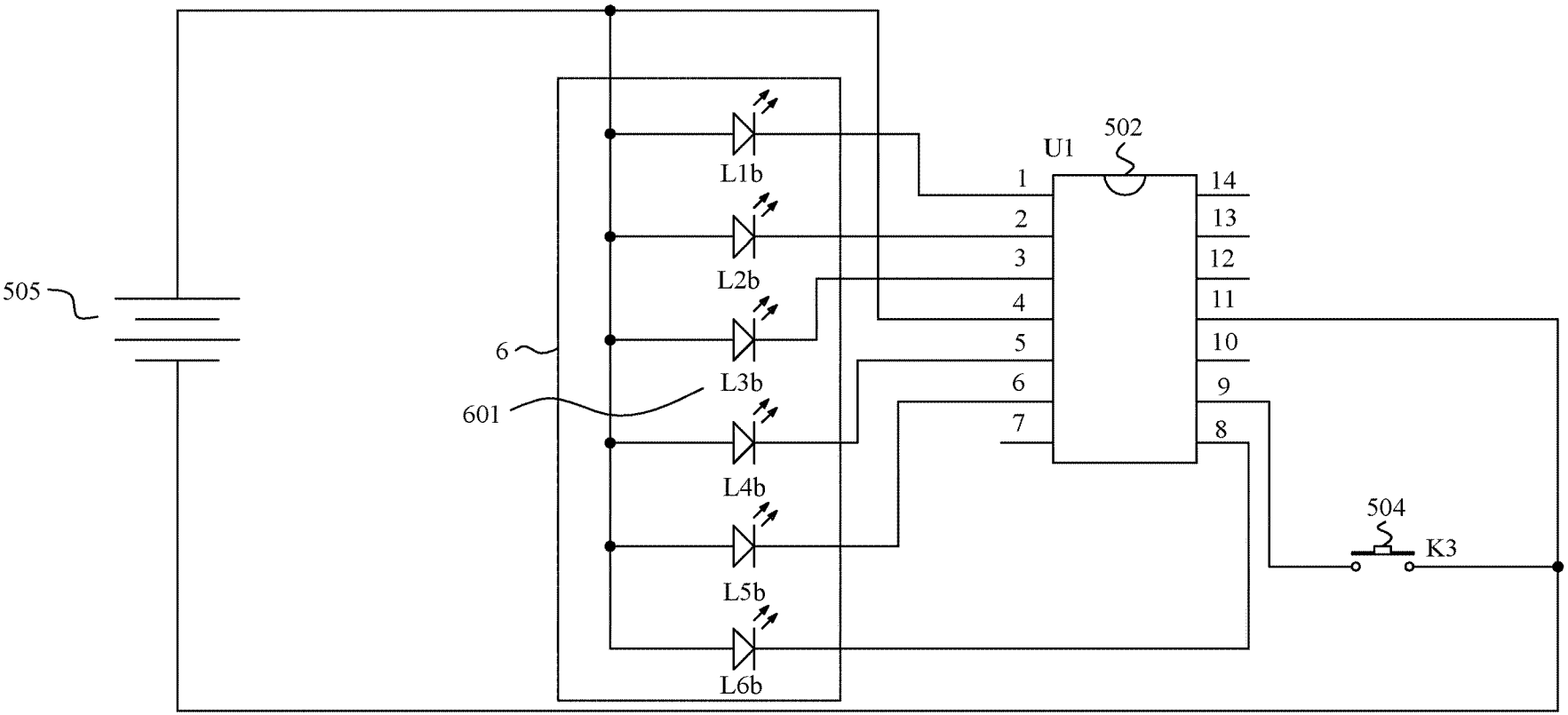
FIG. 11 is a schematic circuit diagram of another structure of the flicker light according to the present invention.

Referring to FIG. 9 to FIG. 11, an embodiment IV of the present invention is as follows:

The embodiment IV differs from the embodiment I in that: referring to FIG. 9 to FIG. 11, the flicker light designed in the present solution may further include a display control box 5 and a display output LED light board 6. The display control box 5 respectively consists of a shell 501, a control IC 502, a display PCBA 503, a display vibration switch 504 and a CR2032 battery 505. The control IC 502, the display PCBA 503, the display vibration switch 504 and the CR2032 battery 505 are installed in the shell 501 and encapsulated with resin.

The display output LED light board 6 consists of a plurality of LED display lights 601 and a display PCB 602. A bulb surface of the LED display light 601 is in a diamond prismatic shape, so that the transmitted light can make people feel soft and peace after being reflected by the polygonal prismatic surface, and the brightness may not be attenuated.

At the same time, the display control box 51 is electrically connected and communicated with the display output LED light board 6 through an electronic wire.

Referring to FIG. 8, an embodiment V of the present invention is as follows:

A lighting shoe includes a shoe body 4 and the flicker light. The flicker light is arranged on the shoe body 4.

In conclusion, according to the flicker light and the lighting shoe provided by the present invention, through the anti-USB reverse connection protection module, when the user reverses the polarity of charging positive and negative electrodes, the damage of the back-end circuit can be avoided during the charging, thereby preventing the charging accident. By arranging the lithium battery charging/discharging protection module which is used to protect the overcharge and overdischarge of the battery, the overdischarge damage or safety accident caused by the overcharge or over-discharging of the battery can be prevented during the charging; and the control module is configured to drive and display different flicker time sequences and different flicker time every time of the LED lights when in work. The lamp and the control module are driven in a scanning drive mode. According to the flicker light designed in the present solution, by arranging the control module for generating the irregular flicker signals, the signal output end of the control module is electrically connected with the lamp, so that the work flicker time sequence of all LED lights on the lamp in the flicker light is irregular during work; moreover, the work time and number of the LED lights are different every time, thereby achieving a special flicker mode of the flicker light. The flicker light of the above structure is applied to the lighting shoe, which can improve the experience of users.

The above description is only embodiments of the present invention and does not limit the patent scope of the present invention. Any equivalent transformation made by using the contents of the description and drawings of the present invention, or direct or indirect applications to the related arts shall fall within the patent protection scope of the present invention.

What is claimed is:

1. A flicker light comprising a lamp, further comprising a control box and a charging switch, wherein the control box comprises a box body, and a PCBA, a lithium battery and a vibration switch which are arranged in the box body respectively; the PCBA is provided with an anti-USB reverse connection protection module, a charging management module and a lithium battery charging/discharging protection module; a control module for generating irregular flicker signals, wherein a signal output end of the control module is electrically connected with the lamp, the control module is respectively electrically connected with the charging switch, the vibration switch and the charging management module; the charging switch is electrically connected with the anti-USB reverse connection protection module; the charging management module is respectively electrically connected with the anti-USB reverse connection protection module and the lithium battery charging/discharging protection module; and the lithium battery is respectively electrically connected with the charging management module and the lithium battery charging/discharging protection module.

2. The flicker light according to claim 1, wherein a random function code and a vibration frequency counter are prefabricated inside the control module.

3. The flicker light according to claim 1, wherein the lamp comprises two or more luminous units; the two or more luminous units are electrically connected with the signal output end of the control module respectively; each luminous unit is composed of LED lights; and the LED lights adopt a scanning drive work mode.

4. The flicker light according to claim 1, further comprising a flexible PCB, wherein the control module and the lamp are integrally arranged on two opposite side surfaces of the flexible PCB respectively, and the surfaces of the control module and lamp are respectively covered with clear silicone rubber.

5. The flicker light according to claim 3, wherein a bulb surface of the LED light is in a diamond prismatic shape.

6. The flicker light according to claim 4, wherein a bulb surface of the LED light is in a diamond prismatic shape.

7. The flicker light according to claim 1, wherein the anti-USB reverse connection protection module comprises a field effect tube Q1; a grid electrode of the field effect tube Q1 is grounded; a drain electrode of the field effect tube Q1 is electrically connected with the charging switch; and a source electrode of the field effect tube Q1 is electrically connected with the charging management module.

8. The flicker light according to claim 1, wherein the lithium battery charging/discharging protection module comprises a resistor R2, a resistor R3, a capacitor C3, a battery BT, a first lithium battery protection chip U2 and a second lithium battery protection chip U3; an output pin of an overdischarge detection circuit of the first lithium battery protection chip U2 is electrically connected with a first grid electrode pin of the second lithium battery protection chip U3; a negative electrode input pin of a charger of the first lithium battery protection chip U2 is electrically connected with one end of the resistor R3; the other end of the resistor R3 is electrically connected with a second source electrode pin of the second lithium battery protection chip U3, and the other end of the resistor R3 and the second source electrode pin of the second lithium battery protection chip U3 both are grounded; an output pin of an overcharge detection circuit of the first lithium battery protection chip U2 is electrically connected with the second grid electrode pin of the second lithium battery protection chip U3; a power supply positive electrode pin of the first lithium battery protection chip U2 is respectively electrically connected with one end of the resistor R2 and one end of the capacitor C3; a ground pin of the first lithium battery protection chip U2 is respectively connected with the other end of the capacitor C3, the first source electrode pin of the second lithium battery protection chip U3 and a cathode of the battery BT; the other end of the resistor R2 is electrically connected with an anode of the battery BT; the other end of the resistor R2 and the anode of the battery BT both are electrically connected with the lithium battery; and the first source electrode pin of the second lithium battery protection chip U3 is electrically connected with the second drain electrode pin of the second lithium battery protection chip U3.

9. The flicker light according to claim 1, wherein the charging management module comprises a resistor R1, a capacitor C1 and a lithium battery charging chip U5; an open-drain charging state output pin of the lithium battery charging chip U5 is electrically connected with the control module; a ground pin of the lithium battery charging chip U5 is grounded; a charging current output pin of the lithium battery charging chip U5 is electrically connected with the lithium battery; a power supply positive electrode pin of the lithium battery charging chip U5 is respectively electrically connected with one end of the capacitor C1 and the anti-USB reverse connection protection module; the other end of the capacitor C1 is grounded; and a charging current control pin of the lithium battery charging chip U5 is grounded through the resistor R1.

10. The flicker light of claim 1 including a shoe body wherein the flicker light is arranged on the shoe body.

11. The flicker light of claim 2 including a shoe body wherein the flicker light is arranged on the shoe body.

12. The flicker light of claim 3 including A a shoe body wherein the flicker light is arranged on the shoe body.

13. The flicker light of claim 4 including a shoe body wherein the flicker light is arranged on the shoe body.

14. The flicker light of claim 5 including a shoe body wherein the flicker light is arranged on the shoe body.

15. The flicker light of claim 6 including a shoe body wherein the flicker light is arranged on the shoe body.

16. The flicker light of claim 7 including a shoe body wherein the flicker light is arranged on the shoe body.

17. The flicker light of claim 8 including a shoe body wherein the flicker light is arranged on the shoe body.

18. The flicker light of claim 9 including a shoe body wherein the flicker light is arranged on the shoe body.

* * * * *